US005172900A

United States Patent [19]

Uno et al.

[11] Patent Number: 5,172,900

[45] Date of Patent: Dec. 22, 1992

[54] PAPER FEED MECHANISM

[75] Inventors: Kazuo Uno; Junji Shirakawa; Masahiro Yamazaki, all of Ibaraki, Japan

[73] Assignee: Hitachi Koki Co., Ltd., Tokyo, Japan

[21] Appl. No.: 689,437

[22] Filed: Apr. 23, 1991

[30] Foreign Application Priority Data

Apr. 27, 1990 [JP] Japan ..... 2-113007

[51] Int. Cl.[5] ..... B65H 3/52

[52] U.S. Cl. ..... 271/125; 271/270; 271/274

[58] Field of Search ..... 271/121, 124, 125, 265, 271/270, 273, 274

[56] References Cited

U.S. PATENT DOCUMENTS 4,605,217 8/1986 Goi ..... 271/124

FOREIGN PATENT DOCUMENTS 135037 10/1980 Japan ..... 271/125
135042 10/1980 Japan ..... 271/125
136453 6/1987 Japan ..... 271/265
167151 7/1987 Japan ..... 271/274
106536 4/1990 Japan ..... 271/124
138035 5/1990 Japan ..... 271/265

*Primary Examiner*—Robert P. Olszewski
*Assistant Examiner*—Steven M. Reiss
*Attorney, Agent, or Firm*—Sughrue, Mion, Zinn, Macpeak & Seas

[57] ABSTRACT

A paper feed mechanism comprises a feed roller rotatable in one direction at a predetermined timing, which rotates in an overrunning manner if such need arises, a separation roller disposed in contact with the feed roller, which rotates together with the feed roller when a load torque exceeds a predetermined value, and a pickup roller disposed upstream of the feed roller in the direction of rotation of the feed roller for feeding a paper sheet according to a paper feed instruction, a device for varying the pressing force of the separation roller against the feed roller, a detector provided in the vicinity of the feed roller and the separation roller for detecting the speed of the paper sheet fed by the feed roller and the separation roller; and a controller for controlling the pressing force of the separation roller according to the detection signal from the detection.

2 Claims, 4 Drawing Sheets

VARIATION RELATIVE TO REFERENCE TIME

VARIATION RELATIVE TO REFERENCE TIME

PAPER FEED MECHANISM

BACKGROUND OF THE INVENTION

This invention relates to a paper feed mechanism for a printing device of the electrophotographic type.

In a conventional paper feed mechanism for a printing device of the electrophotographic type, a number of paper sheets stacked on a paper stack tray 2 are fed individually by a pickup roller 3 as shown in FIG. 6. An uppermost one of the stack of paper sheets is fed first. The primary advantage of this paper feed mechanism are the accuracy of the paper feed, and the prevention of a double paper feed. One known method of positively feeding a number of stacked paper sheets one by one from the upper side employs a torque limiter. In this case, the paper sheet 1 is fed by the pickup roller 3, and the double paper feed is prevented by a feed roller 4 and separation roller 5 disposed downstream of the pickup roller. The separation roller 5 has the same axis of rotation as a torque limiter 7 mounted on a non-rotatable shaft 6. The separation roller 5 is connected to the torque limiter 7 via a coupling, and is pressed against the feed roller 4 by a spring 10.

Because of the provision of the torque limiter 7, the separation roller 5 will not be rotated if it does not receive a certain amount of load. Namely, as the load on the separation roller 5 increases, the separation roller 5 rotates together with the feed roller 4, and the two rollers rotate in the same direction at the point of contact therebetween.

Generally, the coefficient of friction between paper sheets is smaller than the coefficient of friction between a paper sheet and a rubber roller. Therefore, when two paper sheets are interposed between the separation roller 5 and the feed roller 4, the load on the separation roller 5 is relatively small, so that the separation roller 5 is not rotated to stop the paper sheet in contact with the separation roller 5. On the other hand, either when no paper sheet exists between the separation roller 5 and the feed roller 4, or when one paper sheet exists between the two rollers, the load exerted on the separation roller 5 is relatively large, so that the separation roller rotates together with the feed roller 4 to feed the paper sheet in cooperation with the feed roller 4 if the paper sheet exists between the two rollers.

In this manner, the paper separation is carried out by the separation roller 5 and the feed roller 4. In order that this operation can be carried out properly, a certain relation must be established between the torque of the torque limiter 7 and the pressing force of the separation roller 5.

This relation is expressed by the following formula:

$$T/\mu R < N < T/\mu P - (2M + 3m) \quad (1)$$

$T = \tau / r$ $\tau$:torque of the torque limiter r:radius of the separation roller 5

N:pressing of the separation roller 5

M:pressing force of the pickup roller against the sheet m:weight per paper sheet $\mu R$:friction coefficient between the sheet and the roller $\mu P$:friction coefficient between the paper sheets.

FIG. 7 is a graph representing the formula (1). In order for the paper sheet to be positively separated, it is necessary that the relation between T and N should be in the region enclosed by a line of $N = T/\mu P - (2M + 3m)$ and a line of $N = T/\mu R$. Generally, T has a constant value, and therefore the value of N is adjusted so as to satisfy the formula (1).

In order to enhance the accuracy of paper feed and the reliability of prevention of double paper feed, the environment, the aging change and variations in parts must be taken into consideration. Generally, $\mu P$ increases when the temperature and moisture become high, and $\mu R$ decreases with age. Therefore, it is necessary that the adjustment of N should be made considering the maximum value of $\mu P$ and the minimum value of $\mu R$, and this range is narrow as clearly seen from FIG. 7.

In view of variations in the torque limiter 7, it is possible that the adjustment range of N is further narrowed. For example, in FIG. 7, assuming that T is T0 and that its tolerance is $\pm\Delta T$, and the adjustment range is $N1 < N \leqq N1'$ in the case of $T = T0 - \Delta T$, and the adjustment range is $N2 < N \leqq N2'$ in the case of $T = T0 + \Delta T$. Then, in the case of $N2 \leqq N1$, there exists N which satisfies the formula (1) in the range of $T = T0 + \Delta T$. However, a value of N which satisfies all of these equations exists only in the range of $N2 < N \leqq N1'$, thus the operation region is decreased. In contrast, in the case of $N2 > N1'$, there does not exist a value of N which satisfies the formula (1). If N is adjusted to the range of $N1 < N \leqq N1'$, the paper sheet can not be fed by the separation roller 5 and the feed roller 4 in the case of $T = T0 + \Delta T$. Also, if N is adjusted to the range of $N2 < N \leqq N2'$, the double paper feed may not be prevented in the case of $T = T0 - \Delta T$.

Thus, there it is problematic that the adjustment range of N is easily influenced by the values of $\mu P$, $\mu R$ and T and therefore a satisfactory value of N can not easily be determined.

SUMMARY OF THE INVENTION

It is an object of this invention to provide a paper feed mechanism which overcomes the above deficiencies of the prior art, so as to achieve stable paper feed and a double paper feed prevention.

According to the present invention, in order to change the relation between the torque of a torque limiter and the pressing force of a separation roller in accordance with the environment, age and variations of parts, the speed of a paper sheet is used as a parameter for realizing the current relation between the torque and the pressing force, and the pressing force is changed in accordance with the speed of the paper sheet fed by the separation roller and a feed roller.

DETAILED DESCRIPTION OF THE PREFERRED EMBODIMENTS

A preferred embodiment of the present invention shown in FIGS. 1 to 5 will now be described in detail.

Figure 1:
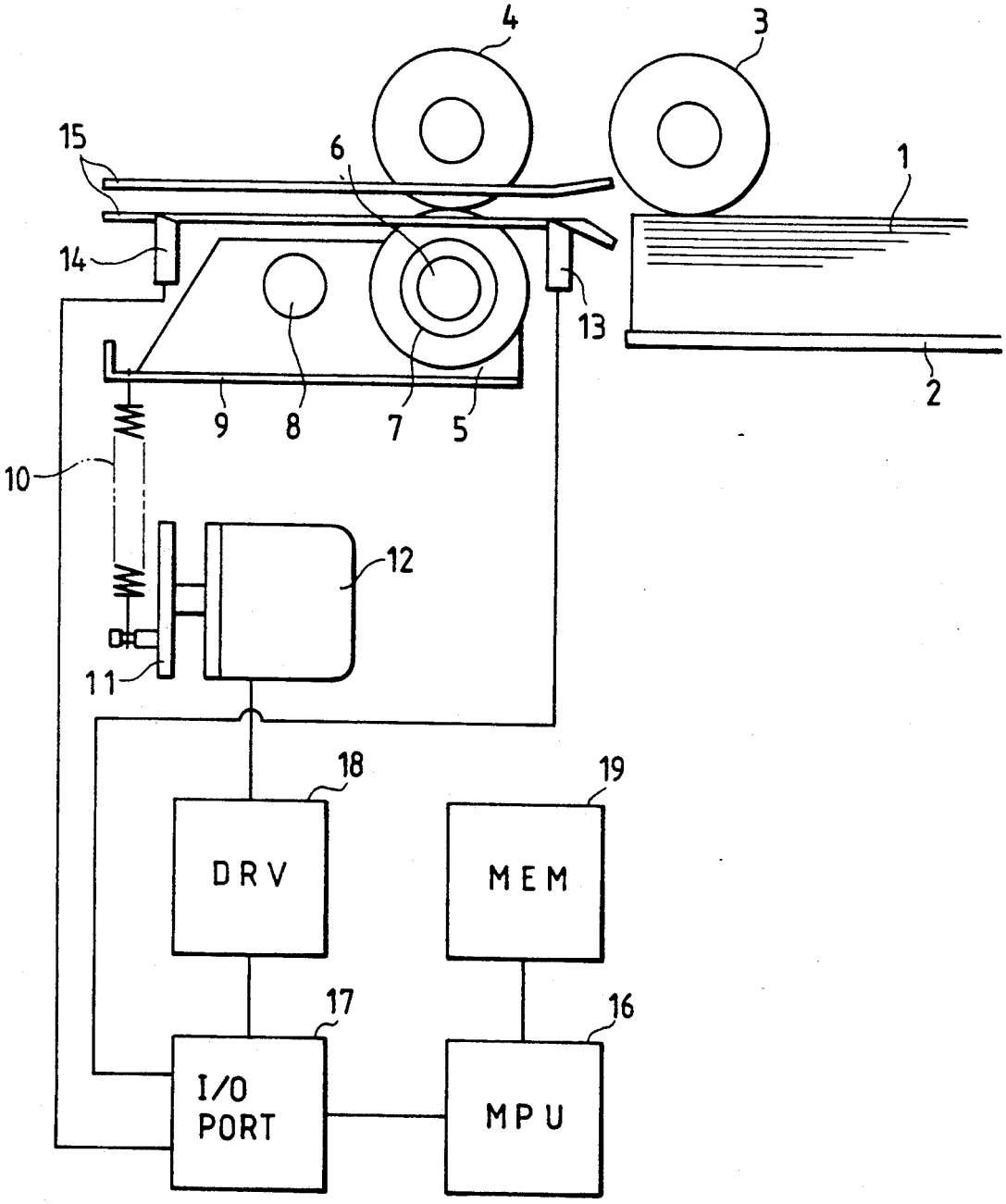
FIG. 1 is a block diagram showing a preferred embodiment of a paper feed mechanism of the present invention.
Figure 2:
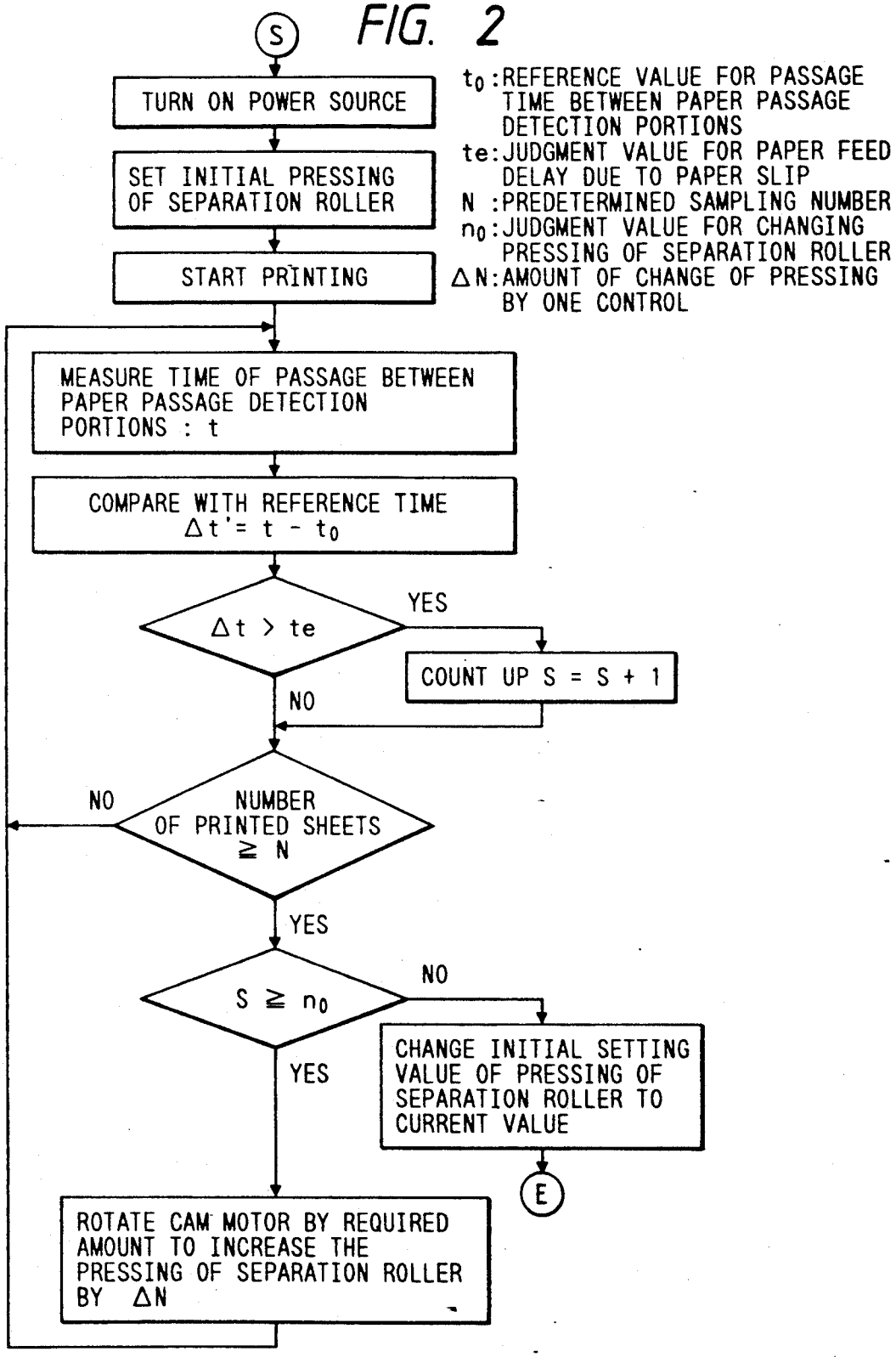
FIG. 2 is a flow chart of the procedure of controlling the paper feed mechanism of the present invention.

FIG. 1 is a block diagram of a preferred embodiment of a paper feed mechanism of the present invention. Paper sheets 1 are stacked on a paper stack tray 2, and a pickup roller 3 is held in contact with the uppermost one of the paper sheets 1 under a predetermined pressure. A feed roller 4 and a separation roller 5 are provided downstream of the pickup roller 3, and are in contact with each other. The separation roller 5 is mounted, together with a torque limiter 7, on a non-rotatable shaft 6. The shaft 6 is mounted on a holder member 9 pivotal about a pivotal axis 8. A spring 10 is engaged with one end of the holder member 9 to press the separation roller 5 against the feed roller 4. The other end of the spring 10 is connected to a cam 11 which is mounted on a shaft of a stepper motor 12 which can be controlled to stop at any desired step. A paper passage detection portion 13 is provided between the pickuproller 3 and the feed roller 4, and a paper passage detection portion 14 is provided downstream of the feed roller 4. A processor 16 receives outputs of the paper passage detection portions 13 and 14 via an I/O port 17, and also controls the stop position of the stepping motor 12 via a driver 18. A memory 19 has a plurality of memory locations, and the writing, referencing and renewal of data with respect to the memory 19 are performed by the processor 16. FIG. 2 shows a flow chart of the procedure of controlling the paper feed mechanism of the invention.

Next, operation of the paper feed mechanism of the present invention will now be described.

Figure 3:
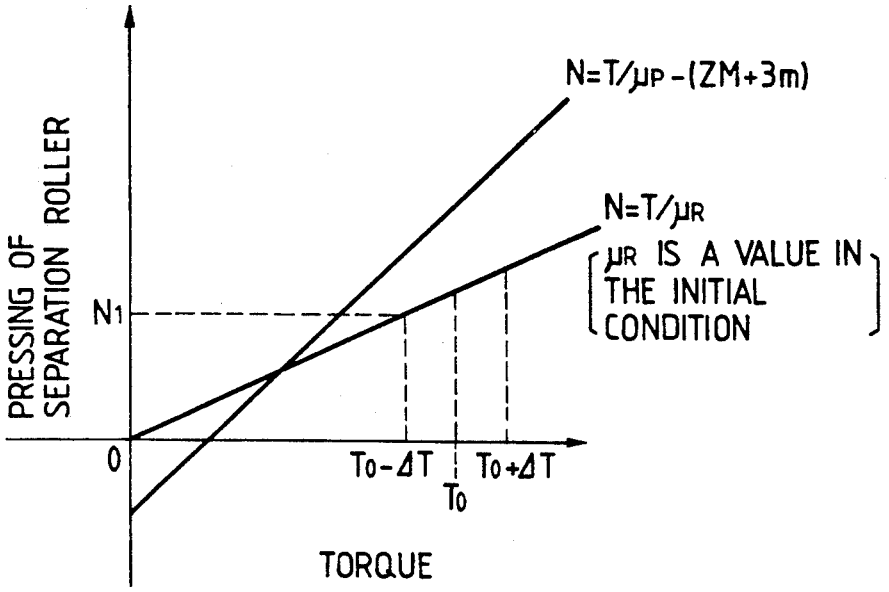
FIGS. 3 and 7 are graphs each showing the relation between the torque of a torque limiter and the pressing of a separation roller.

When a power source of the device is turned on, the initial position setting of the stepping motor 12 is done. In FIG. 3, the initial position of the stepping motor is so set that the pressing N of the separation roller 5 is represented by $N=N1$ (the minimum value to satisfy the formula (1) in the case of $T=T0-\Delta T$).

When the printing starts, the pickup roller 3 responds to a paper feed instruction to feed the uppermost one of the paper sheets 1 on the paper stack tray 2. The paper sheet 1 thus fed passes past the paper passage detection portion 13, and is fed by the feed roller 4 and the separation roller 5, and passes past the paper passage detection portion 14. At this time, the time period between the outputs from the two paper passage detection portions is inputted into the processor 16 via the I/O port 17, and this time period is compared with a predetermined reference time. Next, it is determined whether or not the difference between this time period and the reference time is more than $\Delta t$, and this data is recorded in the memory M.

Figure 4:
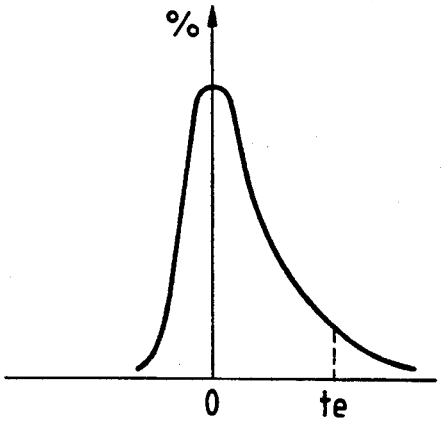
FIGS. 4 and 5 are graphs each showing variations in the time of passage between paper passage detection portions.
Figure 5:
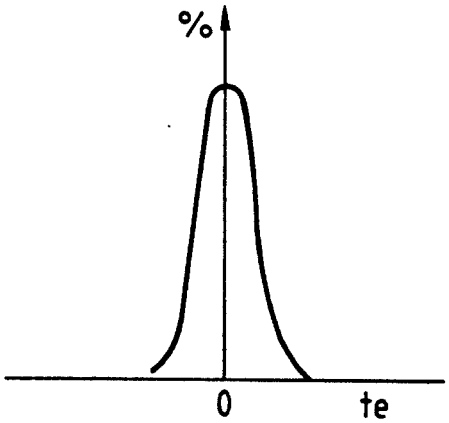
Figure 6:
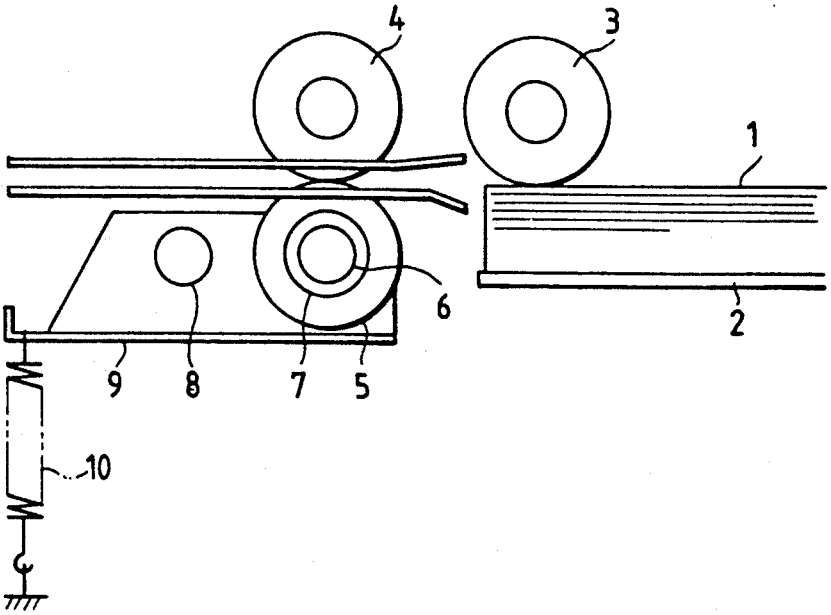
FIG. 6 PRIOR ART
FIG. 6 is a schematic view of a conventional paper feed mechanism.
Figure 7:
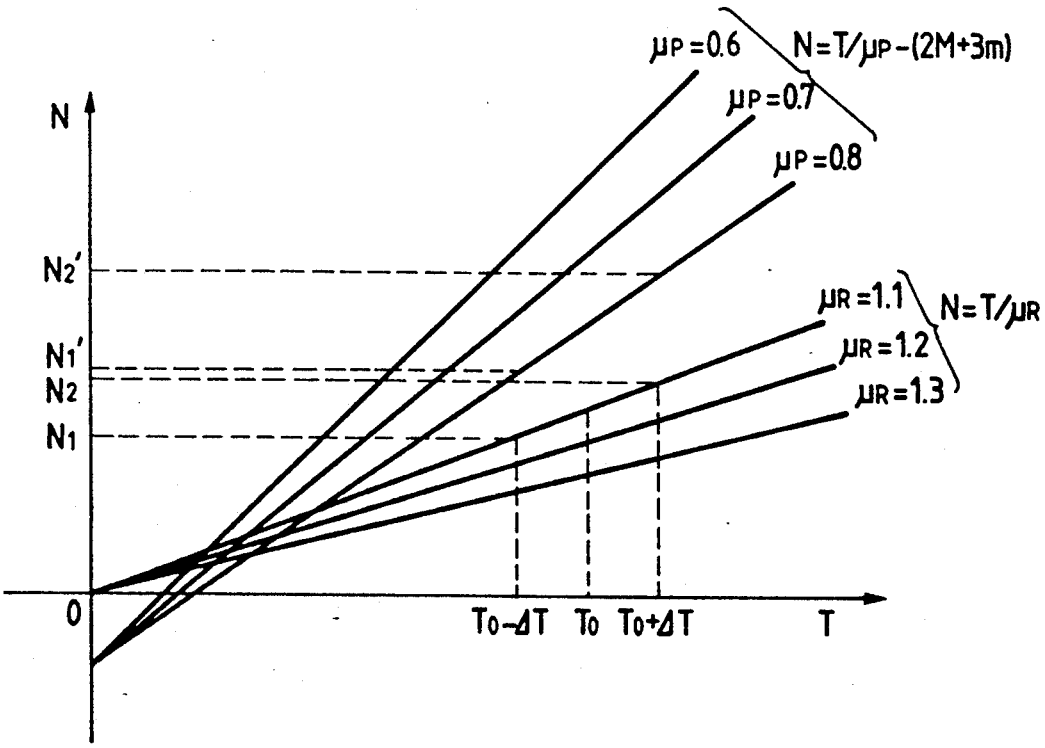

This procedure is repeated, and after n sets of data are taken, it is determined whether or not out of the n sets of data, there are n0 sets above $\Delta t$ (the difference between the above time period and the reference time). This utilizes the following characteristics. Namely, when the relation between the torque of the torque limiter 7 and the pressing of the separation roller 5 is set generally to $N=T/\mu R$ (FIG. 3), variations in the time of passage between the two paper passage detection portions become larger as shown in FIG. 4, and as the pressing N is gradually increased, the variations in this passage time become smaller as shown in FIG. 5.

If the judgment result is that there are more than n0 data, then the processor 16 rotates the stepping motor 12 a required amount via the driver 18 to increase the pressing of the separation roller 5 by $\Delta N$. Then, the speed of the paper sheet is again measured, and the procedure is repeated until the judgment result becomes smaller than n0. When the judgment result is smaller than n0, it is judged that the relation between the torque and the pressing is proper, and this is used as the next initial setting value.

The above sequential operation may be carried out only at the time of the printing immediately after the power source is turned on, or may be carried out at any desired time during the printing.

The actual values of the signs T0, N1, $\Delta t1$, n0, n and so on used above differ depending on the characteristics of the paper feed mechanism, and are used here in a generalized manner.

According to the present invention, the relation between the torque of the torque limiter for the separation roller and the pressing force of the separation roller can be optimized, and therefore the following advantages can be achieved.

(1) The reliabilities of the paper feed and the double paper feed prevention are enhanced.

(2) The lifetime of the roller is prolonged (Even if the friction coefficient is lowered due to the aging this can be accounted for by increasing the force pressing).

(3) There is no need to manually adjust the pressing force.

What is claimed is:

1. A paper feed mechanism, comprising:

a feed roller rotatably in one direction at a predetermined timing;

a torque limiter;

a separation roller, rotatably mounted in operative engagement with said torque limiter, disposed in rotatable contact with said feed roller, so as to rotate together with said feed roller when a load torque on said separation roller exceeds a predetermined value; and a pickup roller disposed upstream of said feed roller relative to the direction of rotation of said feed roller for feeding a paper sheet in response to a paper feed instruction;

means for varying a pressing force of said separation roller against said feed roller;

detection means provided in the vicinity of said feed roller and said separation roller for directly detecting the speed of the paper sheet fed by said feed roller and said separation roller; and means for controlling said varying means according to a detection signal from said detection means.

2. A paper feed mechanism according to claim 1, wherein said varying means increases the pressing force of said separation roller when said speed of the paper sheet is lower than a predetermined reference value.

* * * * *